US006910903B2

(12) United States Patent
Kondas

(10) Patent No.: US 6,910,903 B2
(45) Date of Patent: Jun. 28, 2005

(54) RECEPTACLE MOUNTING BRACKET ATTACHED TO FRAME

(75) Inventor: Shawn J. Kondas, Kendallville, IN (US)

(73) Assignee: Pent Technologies, Inc., Kendallville, IN (US)

( * ) Notice: Subject to any disclaimer, the term of this patent is extended or adjusted under 35 U.S.C. 154(b) by 0 days.

(21) Appl. No.: 10/656,669

(22) Filed: Sep. 4, 2003

(65) Prior Publication Data

US 2004/0053527 A1 Mar. 18, 2004

Related U.S. Application Data

(60) Provisional application No. 60/408,373, filed on Sep. 5, 2002.

(51) Int. Cl.[7] ..... H01R 4/60

(52) U.S. Cl. ..... 439/215; 174/68.1; 174/68.3; 248/68.1

(58) Field of Search ..... 174/68.1, 72 R, 174/72 A, 21 R, 70 C, 47; 439/215, 49, 211; 248/68.1; 52/220.7

(56) References Cited

U.S. PATENT DOCUMENTS

| | | | | |
|---|---|---|---|---|
| 4,918,886 A | | 4/1990 | Benoit et al. | 52/221 |
| 5,013,252 A | | 5/1991 | Nienhuis et al. | 438/215 |
| 5,112,240 A | | 5/1992 | Nienhuis et al. | 439/215 |
| 5,131,860 A | * | 7/1992 | Bogiel | 439/215 |
| 5,171,159 A | * | 12/1992 | Byrne | 439/215 |
| 5,214,889 A | | 6/1993 | Nienhuis et al. | 52/220.7 |
| 5,336,097 A | | 8/1994 | Williamson, Jr. et al. | 439/94 |
| 5,412,529 A | | 5/1995 | Eaton et al. | 361/90 |
| 5,562,469 A | | 10/1996 | Nienhuis et al. | 439/275 |
| 5,595,495 A | | 1/1997 | Johnson et al. | 439/215 |
| 5,607,317 A | | 3/1997 | King et al. | 439/215 |
| 5,728,970 A | | 3/1998 | Karst et al. | 174/48 |
| 5,901,512 A | | 5/1999 | Bullwinkle | 52/220.7 |
| 6,478,602 B1 | * | 11/2002 | Chapman et al. | 439/373 |

* cited by examiner

*Primary Examiner*—Dhiru R. Patel
(74) *Attorney, Agent, or Firm*—Taylor & Aust, P.C.

(57) ABSTRACT

A modular wall panel assembly including a modular wall panel and a mounting bracket connected to the modular wall panel. The mounting bracket includes a base configured for connection to the modular wall panel and a pair of parallel side plates connected to and extending transverse from the base. An electrical distribution harness is included with at least one channel at least partially enclosed by the pair of parallel side plates.

9 Claims, 3 Drawing Sheets

RECEPTACLE MOUNTING BRACKET ATTACHED TO FRAME

CROSS REFERENCE TO RELATED APPLICATIONS

This is a non-provisional application based upon U.S. provisional patent application Ser. No. 60/408,373, entitled "RECEPTACLE MOUNTING BRACKET ATTACHED TO FRAME", filed Sep. 5, 2002.

BACKGROUND OF THE INVENTION

1. Field of the Invention

The present invention relates to electrical distribution harnesses for modular wall panels, and, more particularly, to a method and a device for mounting electrical receptacles and/or the electrical distribution harness to the modular wall panel.

2. Description of the Related Art

Electrical distribution harnesses are located in modular wall panels to provide electrical power to a user located in a space defined by the wall panels. The electrical power can be used to power lighting, computers and other office machines in an office environment, or can be used to power lighting, tools and other equipment in a laboratory or industrial setting.

The electrical distribution harnesses are hidden within the modular wall panel, typically near to or attached to a frame of the modular wall panel, and provide user access to the electricity via receptacles, such as standard duplex receptacles.

The receptacle components need to electrically connect to the electrical distribution harness. Mechanical forces are applied to the receptacle, and therefore to the electrical distribution harness via the receptacle, when plugging and unplugging a power cord and the like. A stable mechanical connection is required for the receptacle to ensure that the receptacle does not work itself loose from the electrical distribution harness after multiple power cord plugging and unplugging cycles. A stable mechanical connection is also required for the electrical distribution harness to ensure that the electrical distribution harness does not work itself loose from the modular wall panel after multiple power cord plugging and unplugging cycles.

A method of mounting a receptacle to an electrical distribution harness is known whereby a receptacle retaining element is part of the electrical distribution harness and includes legs that connect to the modular wall panel. The receptacle electrically connects to an electrical port on the harness and mechanically mounts into the receptacle retaining element. A problem with this method is the receptacle retaining element adds complexity to the harness design, and at least as importantly, increases the manufacturing cycle time of the harness. Other known methods include clips (which are also part of the electrical distribution harness) to hold the receptacle module and the clips are susceptible to bending and provide limited retaining force in the direction of plug engagement and disengagement. The previously mentioned legs that interconnect the electrical distribution harness and the modular wall panel also provide limited retaining force in the direction of plug engagement and disengagement.

What is needed in the art is a device and method that mechanically holds a receptacle to an electrical distribution harness in a reliable and cost effective manner, and at the same time, is separate from the electrical distribution harness, and that can be used to hold the electrical distribution harness to the modular wall panel.

SUMMARY OF THE INVENTION

The present invention provides a device and method to hold a receptacle module to an electrical distribution harness, the device is separate from the electrical distribution harness, and can also be used to hold the electrical distribution harness to the modular wall panel.

The invention comprises, in one form thereof, a modular wall panel assembly including a modular wall panel and a mounting bracket connected to the modular wall panel. The mounting bracket includes a base configured for connection to the modular wall panel and a pair of parallel side plates connected to and extending transverse from the base. An electrical distribution harness is included with at least one channel at least partially enclosed by the pair of parallel side plates.

An advantage of the present invention is that it provides a device and method that mechanically holds a receptacle to an electrical distribution harness in a reliable and cost effective manner, and that it can also be used to hold the electrical distribution harness to the modular wall panel.

Another advantage of the present invention is that it is not part of the electrical distribution harness.

Yet another advantage of the present invention is that it provides a positive retaining force in the direction of plug engagement and disengagement for both the receptacle and the electrical distribution harness.

A further advantage of the present invention is that it can be used with existing designs of receptacle modules.

A yet further advantage of the present invention is that an existing electrical distribution harness can be converted to a design with a separate mounting bracket.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrate one preferred embodiment of the invention, in one form, and such exemplification is not to be construed as limiting the scope of the invention in any manner.

DETAILED DESCRIPTION OF THE INVENTION

Figure 1:
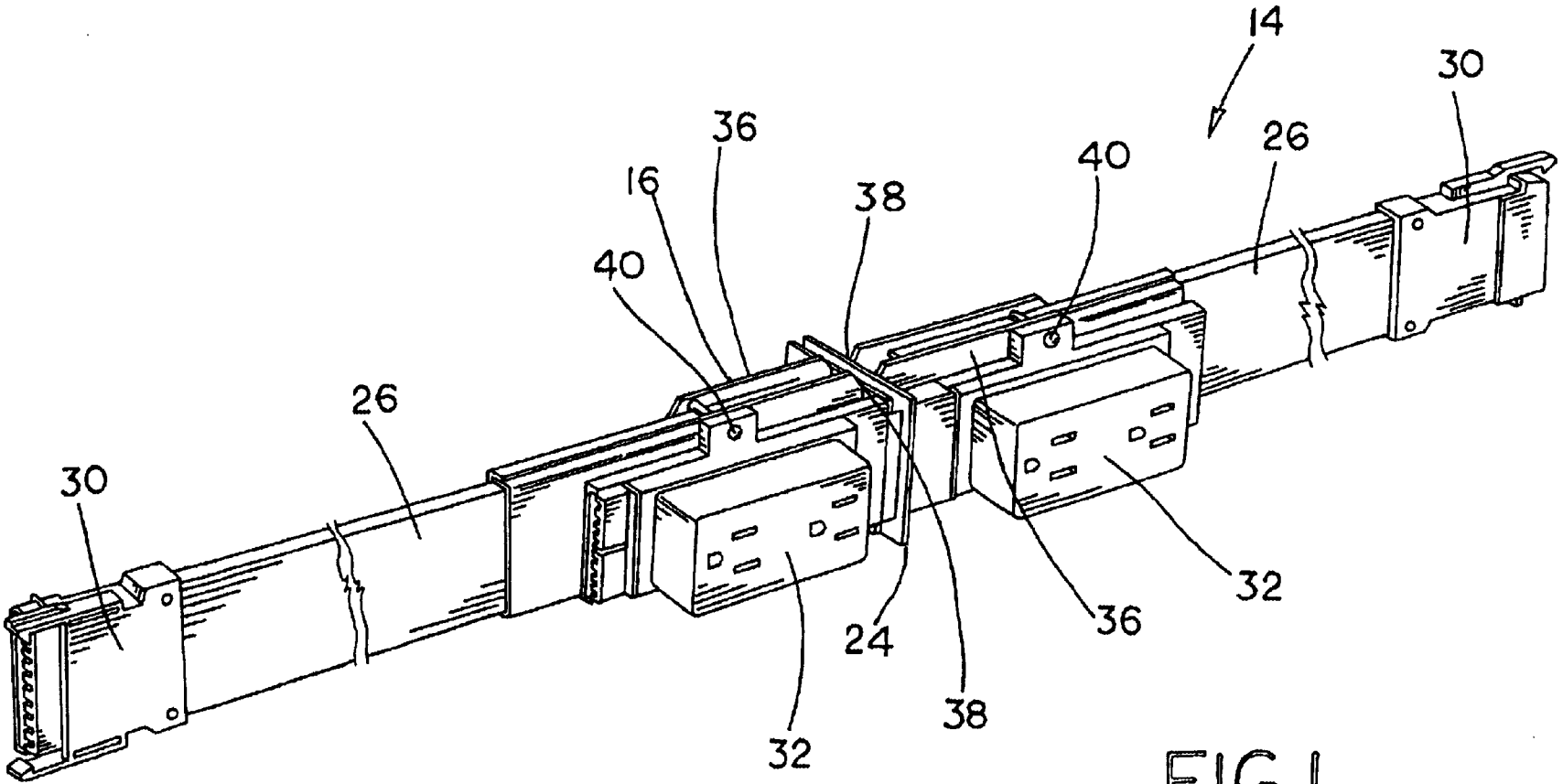
FIG. 1 is perspective view of an embodiment of an electrical distribution harness with a mounting bracket according to the present invention.
Figure 2:
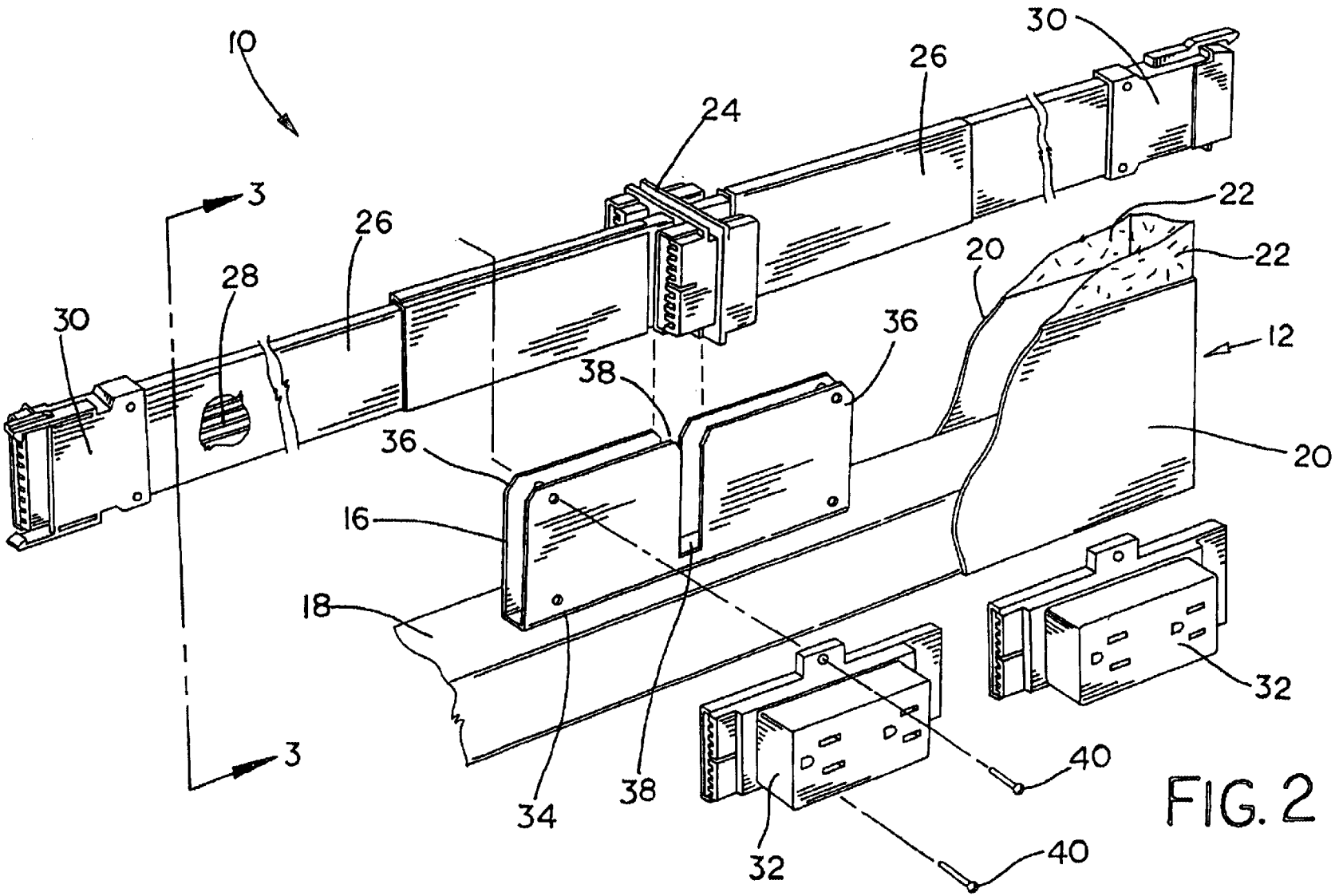
FIG. 2 is an exploded view of the electrical distribution harness of FIG. 1 shown in relation to a partial fragmentary exploded view of an embodiment of a modular wall panel.

Referring now to the drawings, and more particularly to FIG. 2, there is shown a modular wall panel assembly 10 which generally includes a modular wall panel 12, an electrical distribution harness 14 and a mounting bracket 16.

Modular wall panel 12 includes wall frame 18, base cover 20 and panels 22. Base cover 20 can include at least one aperture (not shown) through which an electrical receptacle can protrude.

Electrical distribution harness 14 includes electrical connector 24 and at least one channel 26 extending from and electrically connected, via conductors 28, with electrical connector 24. The number of conductors 28 can vary from application to application, but will generally include ground, neutral and line conductors, or some combination and/or multiples thereof. Isolated circuit conductors and/or isolated grounds can be included. Conductors 28 electrically interconnect terminals in electrical connector 24 with corresponding terminals in end connectors 30. End connectors 30 are typically connected to a source of electrical power, another electrical distribution harness and/or a jumper cable (all not shown). At least one electrical receptacle 32 is connected to electrical connector 24. In the embodiment shown, four electrical receptacles 32 can be connected to electrical connector 24 with two electrical receptacles 32 on each side of electrical distribution harness 14 although only two electrical receptacles 32 are shown.

Figure 3:
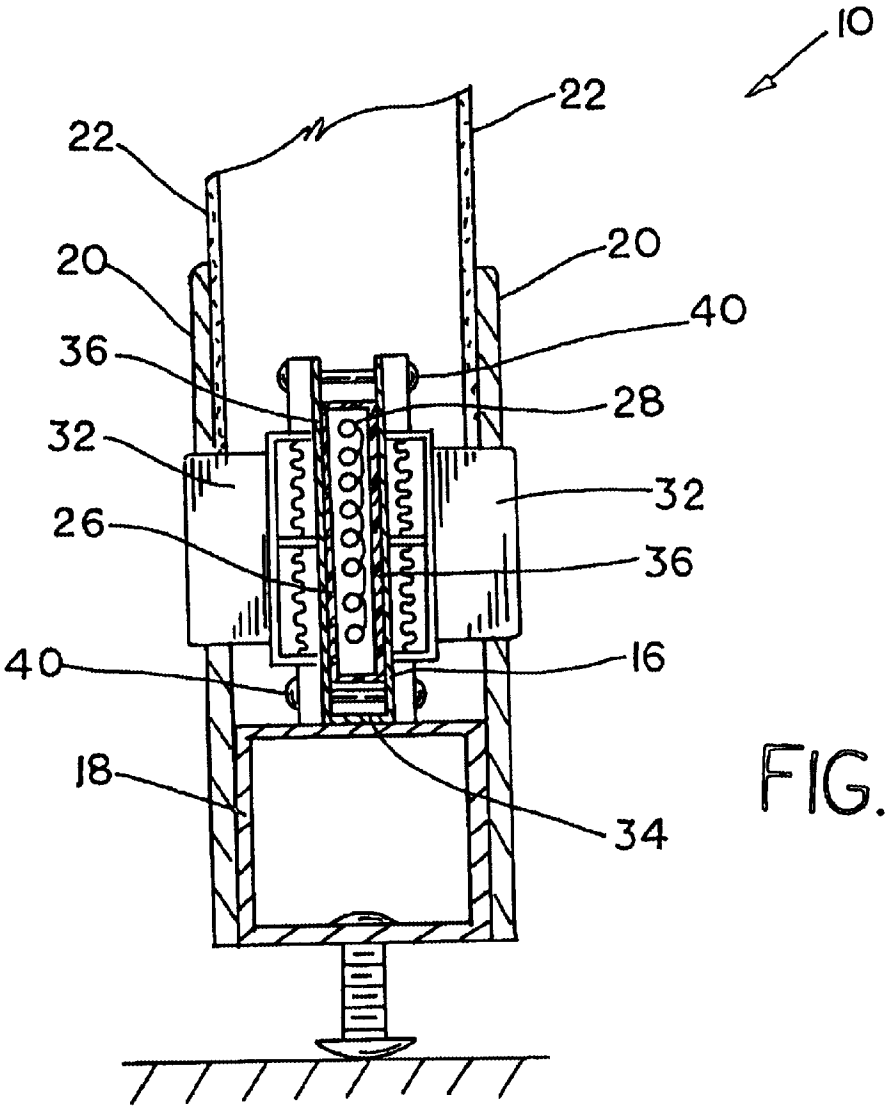
FIG. 3 is a cross-sectional view of the modular wall panel assembly of FIG. 2 as viewed from section line 3—3 when assembled.

Mounting bracket 16 is connected to modular wall panel 12 at wall frame 18, for example, although other mounting configurations are possible. Mounting bracket 16 includes base 34 configured for connection to modular wall panel 12 and a pair of parallel side plates 36 connected to and extending transverse from base 34. Mounting bracket 16 can include a u-shaped cross-section as shown in FIG. 3. Electrical distribution harness 14 has at least one channel 26 at least partially enclosed by the pair of parallel side plates 36. Each parallel side plates 36 can include a slot 38. Slots 38 can be generally aligned with each other with electrical distribution harness 14 including electrical connector 24 received within slots 38. Electrical receptacle 32 can be connected to mounting bracket 16 with fastener 40 for example.

In use, electrical distribution harness 14 is connected to modular wall panel assembly 10 by connecting mounting bracket 16 to modular wall panel assembly 10. Electrical distribution harness 14 is inserted into mounting bracket 16 with at least one electrical connector 24 at least partially disposed within at least one slot 38. At least one receptacle 32 can be electrically connected to at least one electrical connector 24. At least one receptacle 32 can be attached to mounting bracket 16.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A modular wall panel assembly, comprising:

a modular wall panel;

a mounting bracket connected to said modular wall panel, said mounting bracket including:

a base configured for connection to said modular wall panel; and a pair of parallel side plates connected to and extending transverse from said base, each said side plate including a slot, said slots being generally aligned with each other, said slots being located approximately centrally in a longitudinal direction of said mounting bracket;

an electrical distribution harness including at least one channel at least partially enclosed by said side plates, said electrical distribution harness including an electrical connector said electrical connector received within and extending from said slots.

2. The modular wall panel assembly of claim 1, wherein said mounting bracket has a u-shaped cross-section.

3. The modular wall assembly of claim 1, wherein said electrical distribution harness includes:

said at least one channel extending from and electrically connected with said electrical connector; and at least one electrical receptacle connected to said electrical connector.

4. An electrical distribution harness for a modular wall panel, said electrical distribution harness comprising:

a mounting bracket connected to the modular wall panel, said mounting bracket including:

a base configured for connection to the modular wall panel; and a pair of parallel side plates connected to and extending transverse from said base, each said side plate including a slot, said slots being generally aligned with each other, said slots being located approximately centrally in a longitudinal direction of said mounting bracket;

an electrical connector said electrical connector received within and extending from said slots; and at least one channel at least partially enclosed by said pair of parallel side plates.

5. The electrical distribution harness of claim 4, wherein said mounting bracket has a u-shaped cross-section.

6. The electrical distribution harness of claim 4, wherein said electrical distribution harness includes:

said at least one channel extending from and electrically connected with said electrical connector; and at least one electrical receptacle connected to said electrical connector.

7. A method of connecting an electrical distribution harness to a modular wall panel assembly, comprising the steps of:

connecting a mounting bracket to the modular wall panel assembly, said mounting bracket including a base configured for connection to said modular wall panel, and a pair of parallel side plates connected to and extending transverse from said base, each said side plate including a slot, said slots being generally aligned with each other, said slots being located approximately centrally in a longitudinal direction of said mounting bracket; and positioning an electrical connector of the electrical distribution harness at least partially between said side plates, said electrical connector received within and extending from said slots.

8. The method of claim 7, further including the step of electrically connecting at least one receptacle to at least one said electrical connector.

9. The method of claim 8, further including the step attaching at least one said receptacle to said mounting bracket.

* * * * *

UNITED STATES PATENT AND TRADEMARK OFFICE

CERTIFICATE OF CORRECTION

PATENT NO. : 6,910,903 B2
DATED : June 28, 2005
INVENTOR(S) : Kondas

It is certified that error appears in the above-identified patent and that said Letters Patent is hereby corrected as shown below:

Column 4,
Lines 8 and 30, after "connector" and before "said" insert -- , --.

Signed and Sealed this

Twenty-fourth Day of January, 2006

JON W. DUDAS
*Director of the United States Patent and Trademark Office*